US008741823B2

(12) United States Patent
Iwamatsu et al.

(10) Patent No.: US 8,741,823 B2
(45) Date of Patent: Jun. 3, 2014

(54) GREASE COMPOSITION

(75) Inventors: Hiroki Iwamatsu, Kobe (JP); Masashi Mitsuoka, Kobe (JP)

(73) Assignee: Nippon Grease Co., Ltd., Osaka-Shi (JP)

( * ) Notice: Subject to any disclaimer, the term of this patent is extended or adjusted under 35 U.S.C. 154(b) by 119 days.

(21) Appl. No.: 13/445,163

(22) Filed: Apr. 12, 2012

(65) Prior Publication Data

US 2012/0270762 A1 Oct. 25, 2012

(30) Foreign Application Priority Data

Apr. 21, 2011 (JP) ..... 2011-095406

(51) Int. Cl.
*C10M 149/20* (2006.01)
*C10M 115/08* (2006.01)

(52) U.S. Cl.
USPC ..... 508/552

(58) Field of Classification Search
USPC ..... 508/552
See application file for complete search history.

(56) References Cited

U.S. PATENT DOCUMENTS

| | | | | |
|---|---|---|---|---|
| 4,668,411 | A | 5/1987 | Yasui | |
| 6,432,888 | B1 | 8/2002 | Komiya | |
| 2005/0043190 | A1* | 2/2005 | Komiya et al. | 508/183 |

FOREIGN PATENT DOCUMENTS

| | | | |
|---|---|---|---|
| JP | 58-185693 | | 10/1983 |
| JP | 61-155496 | A | 7/1986 |
| JP | 2-242896 | A | 9/1990 |
| JP | 3512183 | B2 | 3/2004 |
| JP | 4102627 | B2 | 6/2008 |

* cited by examiner

*Primary Examiner* — Vishal Vasisth
(74) *Attorney, Agent, or Firm* — Kratz, Quintos & Hanson, LLP

(57) ABSTRACT

There is provided a grease composition, in which a grease film on the surface of the applied part is made thicker compared with conventional grease compositions, this thickness is maintained for a long period of time, and as a result, a longer service life against seizure compared with conventional grease compositions is assured. The grease composition comprises a base oil and a thickener, wherein the thickener is a diurea compound obtained by allowing an amine mixture comprising alkylphenylamine, an alkyl group of which has 8 to 16 carbon atoms, and cyclohexylamine, to react with a diisocyanate compound, and an amount of cyclohexylamine in the total amount of the alkylphenylamine and cyclohexylamine is from 91 to 99% by mole.

2 Claims, 5 Drawing Sheets

GREASE COMPOSITION

INCORPORATION BY REFERENCE

The disclosure of Japanese Patent Application No. 2011-095406 filed on Apr. 21, 2011 including the specification, drawings and abstract, is incorporated herein by reference in its entirety.

TECHNICAL FIELD

The present invention relates to a grease composition comprising a specific thickener.

BACKGROUND OF THE INVENTION

Grease compositions using a diurea compound as a thickener have been proposed so far. For example, JP 61-155496 A discloses a grease composition using, as a thickener, a diurea compound obtained by allowing an amine mixture comprising alkylphenylamine, an alkyl moiety of which has 8 to 16 carbon atoms, and cyclohexylamine in a molar ratio of 1:9 to 9:1, to react with a diisocyanate compound.

SUMMARY OF THE INVENTION

However, grease compositions, which inhibit occurrence of a problem with hydrogen embrittlement and so on and maintain enough lubrication performance for a long period of time without causing failure such as seizure, are demanded as a grease composition to be used on various bearings and sliding parts of machines under strict conditions.

In the present invention, it was found that by using a grease composition prepared by using, as a thickener, a diurea compound obtained by allowing an amine mixture comprising amines in a specific mixing ratio to react with a diisocyanate compound, a film of the grease composition at an applied part can be made thicker and the film thickness is maintained for a long period of time compared with conventional grease compositions, and therefore, an object of the present invention is to provide a novel grease composition assuring a longer service life against seizure compared with conventional grease compositions.

The grease composition of the present invention is a grease composition comprising a base oil and a thickener, wherein the thickener is a diurea compound obtained by allowing an amine mixture comprising alkylphenylamine (also referred to as a specific alkylphenylamine), an alkyl group of which has 8 to 16 carbon atoms, and cyclohexylamine, to react with a diisocyanate compound, and an amount of cyclohexylamine in the total amount of specific alkylphenylamine and cyclohexylamine is from 91 to 99% by mole.

The amount of the thickener is preferably from 9 to 30 parts by mass based on 100 parts by mass of the total amount of the base oil and the thickener.

EFFECT OF THE INVENTION

According to the grease composition of the present invention, a grease film on the surface of the applied part can be made thicker compared with conventional grease compositions, this thickness is maintained for a long period of time, and as a result, a grease composition assuring a longer service life against seizure compared with conventional grease compositions can be provided.

DETAILED DESCRIPTION

Figure 1:
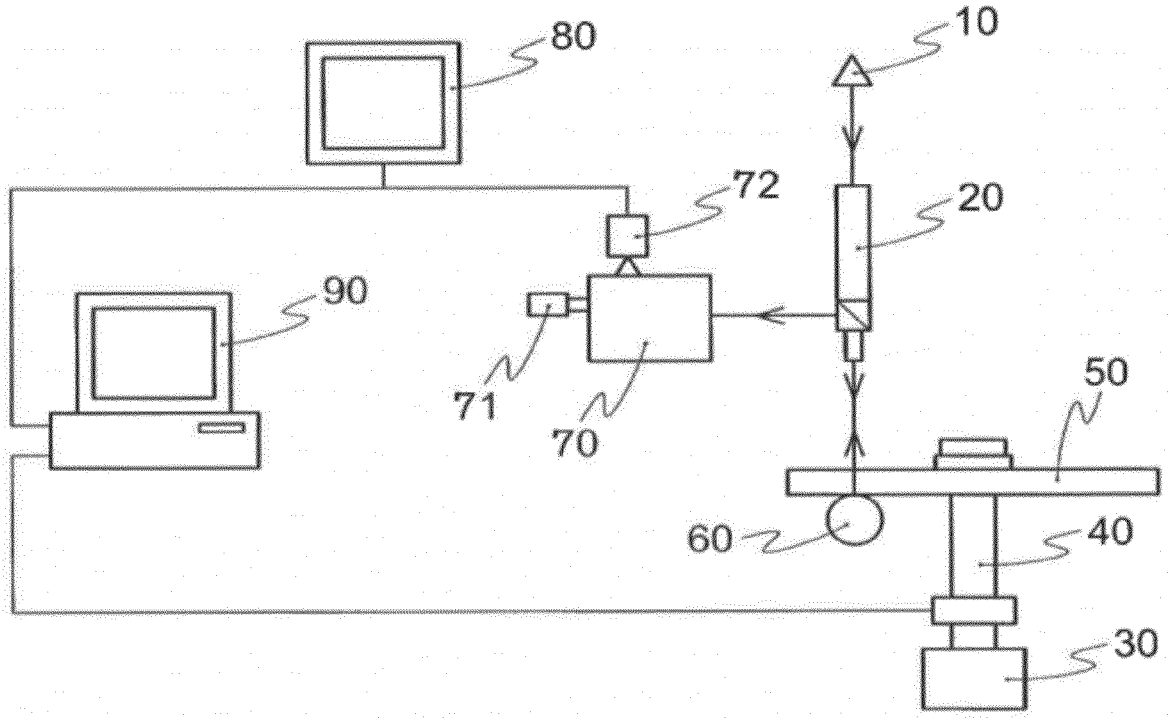
FIG. 1 is a diagrammatic view of an oil film thickness measuring system used in Examples.

The grease composition of the present invention is a grease composition comprising a base oil and a thickener, wherein the thickener is a diurea compound obtained by allowing an amine mixture comprising alkylphenylamine, an alkyl group of which has 8 to 16 carbon atoms, and cyclohexylamine, to react with a diisocyanate compound, and an amount of cyclohexylamine in the total amount of specific alkylphenylamine and cyclohexylamine is from 91 to 99% by mole.

The base oil is not limited particularly as far as it is a base oil to be usually used for a grease composition, and it is possible to use one or two or more of, for example, mineral oils refined from crude oil by optional combination of treatments such as distillation under reduced pressure, solvent deasphalting, solvent extraction, hydrogenolysis, solvent dewaxing, washing with sulfuric acid, clay refining and hydrorefining; synthetic diester oils, for example, dibutyl sebacate, di-2-ethylhexyl sebacate, dioctyl adipate, diisodecyl adipate, ditridecyl adipate, ditridecyl glutarate, methylacetyl ricinoleate, and the like; synthetic aromatic ester oils, for example, trioctyl trimellitate, tridecyl trimellitate, tetraoctyl pyromellitate, and the like; synthetic polyol ester oils, for example, trimethylolpropane caprylate, trimethylolpropane pelargonate, pentaerythritol-2-ethylhexanoate, pentaerythritol pelargonate, and the like; synthetic ester oils, for example, complex ester oils which are oligo esters of polyhydric alcohol and a fatty acid mixture of dibasic acid and monobasic acid; synthetic polyglycol oils, for example, polyethylene glycol, polypropylene glycol, polyethylene glycol monoether, polypropylene glycol monoether, and the like; synthetic phenyl ether oils, for example, monoalkyltriphenyl ether, alkyl diphenyl ether, dialkyl diphenyl ether, pentaphenyl ether, tetraphenyl ether, monoalkyl tetraphenyl ether, dialkyl tetraphenyl ether, and the like; synthetic hydrocarbon oils, for example, poly-α-olefins such as a co-oligomer of normal paraffin, isoparaffin, polybutene, polyisobutylene, 1-deceneoligomer or 1-decene with ethylene, or hydrides thereof; synthetic silicone oils, for example, dimethyl polysiloxane, diphenyl polysiloxane, alkyl-modified polysiloxane, and the like; and further, synthetic fluorine-containing oils, for example, perfluoro polyether. In particular, alkyl diphenyl ether oil is more preferred from the viewpoint of satisfactory heat resistance and peeling resistance.

The thickener to be used in the present invention is a diurea compound which is a reaction product of an amine mixture prepared by mixing alkylphenylamine, an alkyl group of which has 8 to 16 carbon atoms, with cyclohexylamine, in a specific mixing ratio, and a diisocyanate compound.

In the specific alkylphenylamine as a component of the amine mixture, the number of carbon atoms of its alkyl group is from 8 to 16 from the viewpoint of being environmentally friendly, easily available and good in dispersibility. The number of carbon atoms of the alkyl group is further preferably from 10 to 14 from the viewpoint of being easily available and good in dispersibility. In addition, the alkyl group may be linear or branched, and in the phenyl group, the position substituted by the alkyl group may be any of ortho-position, meta-position or para-position. Specific examples thereof are, for example, one or two or more of octylaniline, decylaniline, dodecylaniline, hexadecylaniline, isododecylaniline and the like. From the viewpoint of good dispersibility, para-dodecylaniline is more preferred.

The amount of the above-mentioned cyclohexylamine is 91% by mole or more and 99% by mole or less in the total amount (100 mol %) of specific alkylphenylamine and cyclohexylamine, from the viewpoint of film forming property of the grease composition. A more preferred amount is 93% by mole or more, further 94% by mole or more from the viewpoint of good film forming property of the grease composition, and 98% by mole or less, further 96% by mole or less similarly from the viewpoint of good film forming property of the grease composition.

Aromatic diisocyanates are preferred as the diisocyanate compound to be allowed to react with the amine mixture, from the viewpoint of good heat resistance of the grease composition, and examples thereof are, for example, diphenylmethane-4,4'-diisocyanate, 2,4-trilenediisocyanate, 2,6-trilenediisocyanate, a mixture of 2,4-trilenediisocyanate and 2,6-trilenediisocyanate, 3,3'-dimethyldiphenyl-4,4'-diisocyanate, and the like. In particular, from the viewpoint of availability, diphenylmethane-4,4'-diisocyanate and 2,6-trilenediisocyanate are preferred, and further, diphenylmethane-4,4'-diisocyanate is preferred from the viewpoint of good heat resistance.

The reaction of the amine mixture with the diisocyanate compound can be carried out by various methods under various conditions, and it is preferable to carry out the reaction in the base oil since a diurea compound having highly uniform dispersibility can be obtained as the thickener. For example, the reaction may be carried out by adding the base oil containing the diisocyanate compound dissolved therein to the base oil in which the specific alkylphenylamine and cyclohexylamine have been dissolved, or by adding the base oil, in which the specific alkylphenylamine and cyclohexylamine have been dissolved, to the base oil containing the diisocyanate compound dissolved therein.

The reaction temperature and time in the above-mentioned reaction are not limited particularly, and may be the same as those used in usual similar reactions. The reaction temperature is preferably from 60° C. to 170° C. from the viewpoint of solubility and volatility of the amine mixture and diisocyanate. The reaction time is preferably from 0.5 to 2.0 hours in view of improvement of production efficiency by shortening of the production period of time and also from the viewpoint of completing the reaction of the amine mixture and diisocyanate. The reaction of an amino group of the amine mixture and an isocyanate group of the diisocyanate compound proceeds quantitatively, and a preferred ratio thereof is 1 mole of the diisocyanate compound to 2 mole of the amine mixture.

The diurea compound which is a reaction product obtained by the above-mentioned reaction is a mixture of a diurea compound resulting from a reaction of both isocyanate groups of the diisocyanate compound with a cyclohexylamine or a specific alkylphenylamine in the amine mixture and a diurea compound resulting from a reaction of one isocyanate group of the diisocyanate compound with a cyclohexylamine in the amine mixture and a reaction of another isocyanate group with a specific alkylphenylamine. Here, the diurea compound resulting from a reaction of both isocyanate groups with a cyclohexylamine forms a relatively large thickener fiber, and has excellent properties such as shear stability and adhesion to an applied part. The diurea compound resulting from a reaction of both isocyanate groups with an alkylphenylamine forms a relatively small thickener fiber, and has an excellent property such as a property of intervening to an applied part. In the present invention, with respect to the mixture of diurea compounds, since the amount of the cyclohexylamine in the amine mixture used in the above-mentioned reaction is 91 to 99% by mole in the total amount of specific alkylphenylamine and cyclohexylamine, many of the diurea compounds are the diurea compounds resulting from a reaction of both isocyanate groups of the diisocyanate compound with a cyclohexylamine. It is assumed that in addition to these diurea compounds, by allowing a small amount of diurea compounds resulting from a reaction of both isocyanate groups with alkylphenylamine to be present, a thickness of the grease film on the surface of the applied part can be made thick and the grease film thickness is maintained for a long period of time.

The amount of the above-mentioned thickener in the grease composition is preferably 9 parts by mass or more and 30 parts by mass or less based on 100 parts by mass of the total amount of the base oil and the thickener. When the amount of the thickener is less than the lower limit, the grease tends to be scattered or leaked due to its softness, and when the amount of the thickener is larger than the upper limit, the grease becomes hard, and there is a tendency that a torque of the grease-applied parts increases and a service life is decreased because of seizure by lowering of flowability. A particularly preferred amount is 10 parts by mass or more, further 15 parts by mass or more, from the point that a proper flowability can be obtained, and 28 parts by mass or less, further 25 parts by mass or less, from the point that a proper flowability can be obtained.

In addition, various additives such as an antioxidant, an extreme pressure additive, an antiwear additive, a dye, a color stabilizer, a viscosity improver, a structure stabilizer, a metal deactivator, a viscosity index improver and a rust-preventing additive may be added to the grease composition in proper amounts to such an extent not to impair the effect of the present invention. When these additives are contained in the grease composition, the amount thereof in the grease composition can be 10 parts by mass or less based on 100 parts by mass of the total amount of the base oil and the thickener.

The grease composition of the present invention can be used suitably on various grease-applied parts such as bearings used on auto parts, rolling bearings used on multi-purpose motors in electric appliances and office automation apparatuses, bearings in steel making facilities and other industrial machines, various known ball bearings and roller bearings, ball screws and linear guides of machine tools, various sliding parts of building machines and gears. An amount of the grease composition to be filled in these applied parts can be optionally changed depending on type and dimensions of the applied parts, and may be the same as usual.

The present invention is explained below in detail by means of Examples, but is not limited to these Examples.

Evaluating methods are as follows.

(Film Thickness Measuring Test)

Oil film forming property of sample grease is evaluated using an oil film thickness measuring device to which optical interferometry is applied and which is available from PCS Instruments, FIG. 1 is a diagrammatic view of the oil film thickness measuring system used. Light from the light source 10 is emitted, via the microscope 20, onto the surface of the disc 50 fixed to the spindle 40 rotating by power of the drive motor 30, in which the irradiated surface of the disc 50 is not in contact with the steel ball 60 of the bearing (See FIG. 2). The reflected light is measured using a spectrometer 70 provided with the micrometer 71 and the camera 72. The results of the measurement are displayed, analyzed and reserved on the monitor 80 and the computer 90 via the camera 72.

Figure 2:
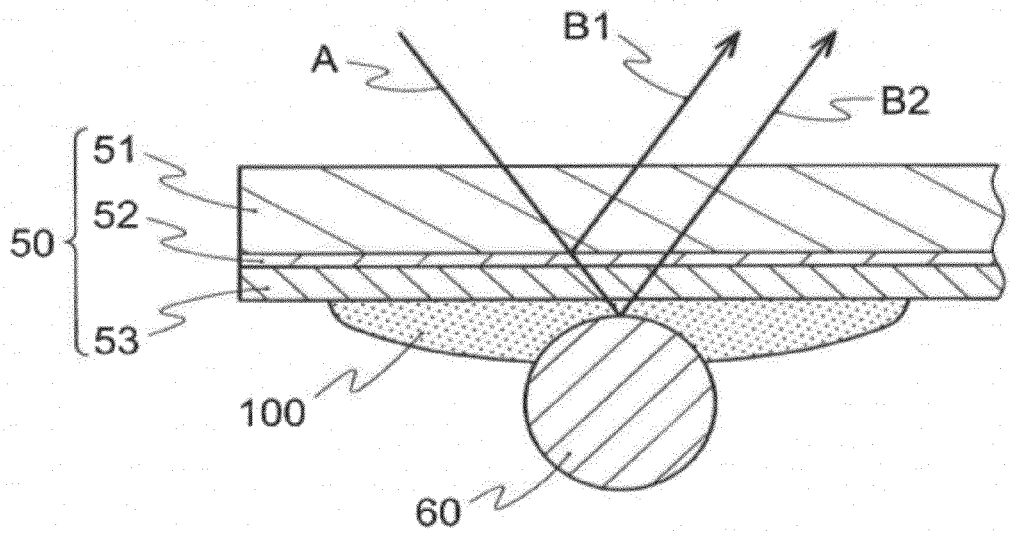
FIG. 2 is a diagrammatic cross-sectional view of a disc, sample grease and a steel hall when emitting light in an oil film thickness measuring device.

FIG. 2 is a diagrammatic cross-sectional view of the disc, sample grease and steel ball of the bearing when emitting light. As shown in FIG. 2, the disc 50 comprises the glass disc 51 and the chromium film 52 and silica film 53 deposited on one surface thereof, and the steel ball 60 of the bearing comes into contact with the surface of the silica film 53. The light is emitted onto the opposite surface of the disc (A), and a part of the emitted light is reflected on the chromium film surface (B1), and the remaining part of the light passes through the chromium film, the silica film and the sample grease 100 and reflected on the steel ball of the bearing (B2). Each of the reflected light is measured using a spectrometer 70.

Figure 3:
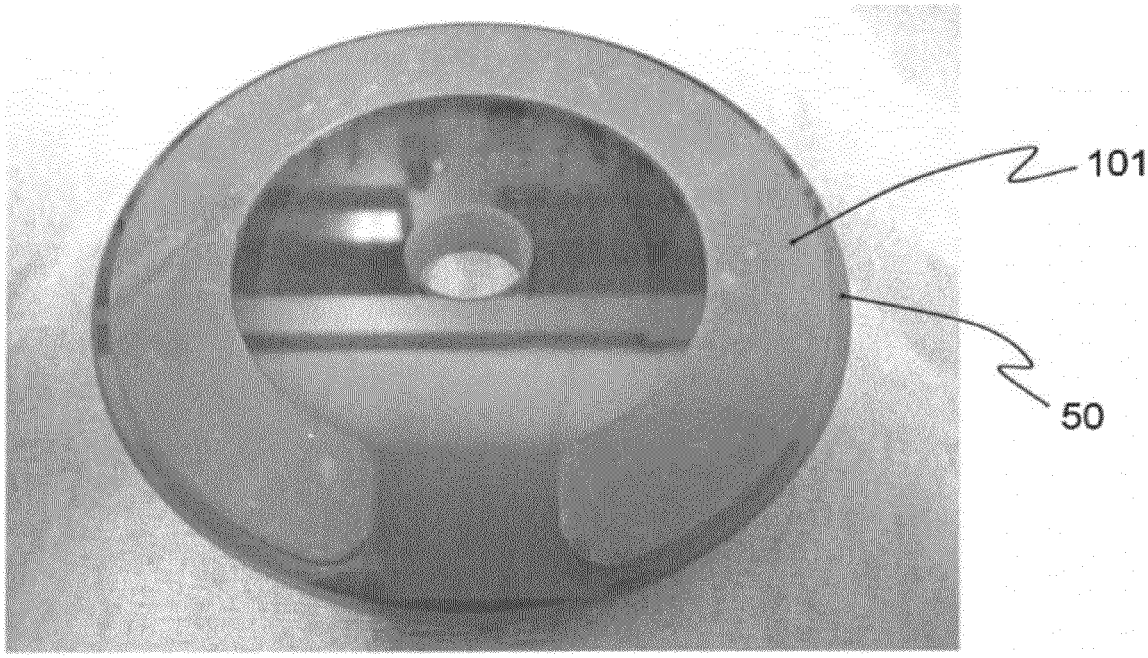
FIG. 3 is a photograph showing a state of sample grease applied on a disc.
Figure 4:
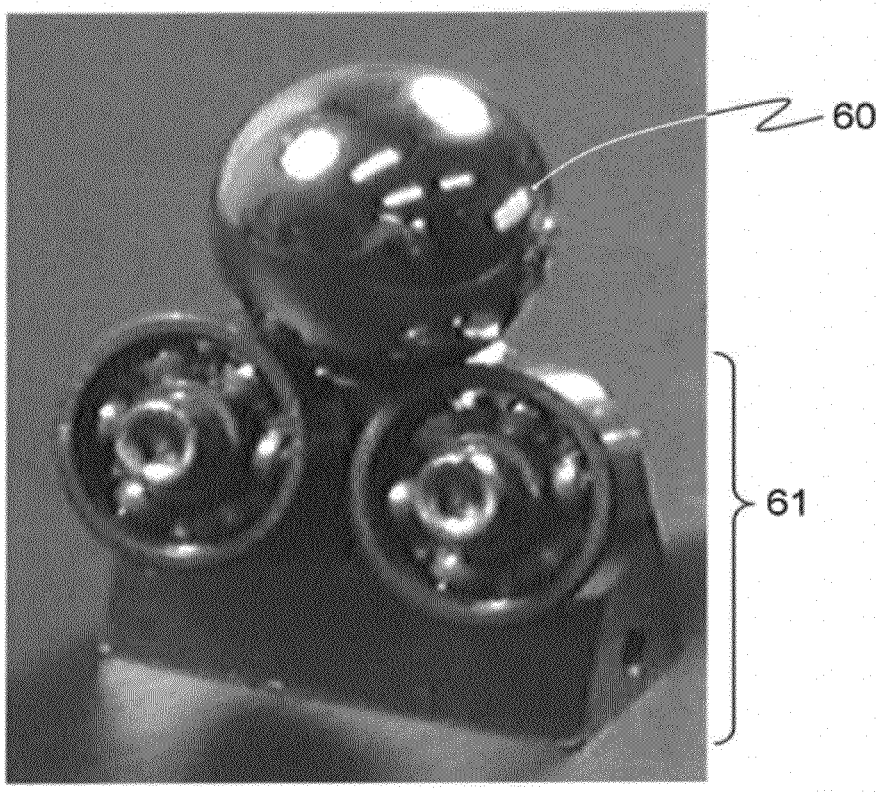
FIG. 4 is a photograph showing a state of a steel ball being placed on a pillow block.

The testing method is concretely explained below. The sample grease 101 is applied on the surface of the disc comprising a hard glass having a diameter of about 10 cm and a chromium film and a silica film deposited on the hard glass in this order. The sample grease is applied in a film thickness of 1 mm on an area of the disc corresponding to the raceway of the ¾ inch diameter steel ball of the bearing using a template. In this case, as shown in FIG. 3, when the test is started, an area where the grease is not applied, namely, an area where the grease film thickness is zero, is left on the disc in order to measure only the thickness of the silica film. A pillow block for receiving the steel ball is prepared by combination of three small ball bearings being rotatable with a sufficiently small force, and as shown in FIG. 4, the ¾ inch diameter steel ball of the bearing is placed on the outer side of these three outer rings. The disc to which the sample grease was applied is fixed to the spindle, and the ¾ inch diameter steel ball of the bearing is set so as to come into contact with the grease-unapplied portion of the disc, and a load of 20 N is applied to the disc from under the pillow block for receiving the steel ball. First, in this state, only the thickness of the silica film between the chromium film and the ¾ inch diameter steel ball is measured by optical interferometry. Then, the spindle is rotated so that the rolling speed of the contacting raceway portion between the disc and the ¾ inch diameter steel ball becomes 0.03 m/s. During a period of time of 20 minutes from the starting of the rotation, the film thickness between the chromium film and the ¾ inch diameter steel ball, namely, the total of the silica film thickness and the sample grease film thickness is measured at intervals of one minute. The measurement of the film thickness is always carried out at the portion where only the thickness of the silica film was measured. A value obtained by subtracting the thickness of the silica film from the measured total thickness of the silica film and the sample grease film is assumed to be the grease film thickness. The sample grease is applied only before the test, and additional sample grease is not applied after starting the rotation of the disc. The test is carried out in the atmosphere of 25° C.

(Test for Service Life Against Seizure)

A service life of sample grease against seizure is evaluated according to ASTM D 1741-86.

| Test conditions are as follows. | |
|---|---|
| Bearing to be tested: | 6306ZZ |
| Amount of grease to be filled: | 6.0 g |

-continued

| Test conditions are as follows. | |
|---|---|
| Number of revolutions: | 3,500 rpm |
| Radial load: | 111 ± 22N |
| Thrust load: | 178 ± 22N |
| Temperature of outer race of bearing: | 150° C. |
| Running cycle: | 20 hr running, and then 4 hr shut-down (intermittent running) |

Test is carried out under the above-mentioned conditions, and a time period taken until occurrence of any of the cases where (1) a current of a drive motor reaches 7 ampere or more (5 ampere at starting the test), (2) a temperature of an outer race of a bearing reaches 160° C. or more (temperature at starting the test (set temperature)+10° C. or more) or (3) a significant noise continues ten minutes or more, is measured, and any of these time periods is assumed to be a service life against seizure.

EXAMPLE

In Examples of the present invention, the following materials were used.

Diisocyanate Compound

MDI: Diphenylmethane-4,4'-diisocyanate

Amine

CHA: Cyclohexylamine

PDA: Para-dodecylaniline

Base Oil

ADE: Alkyl diphenyl ether oil

Examples 1 to 14 and Comparative Examples 1 to 7

Figure 5:
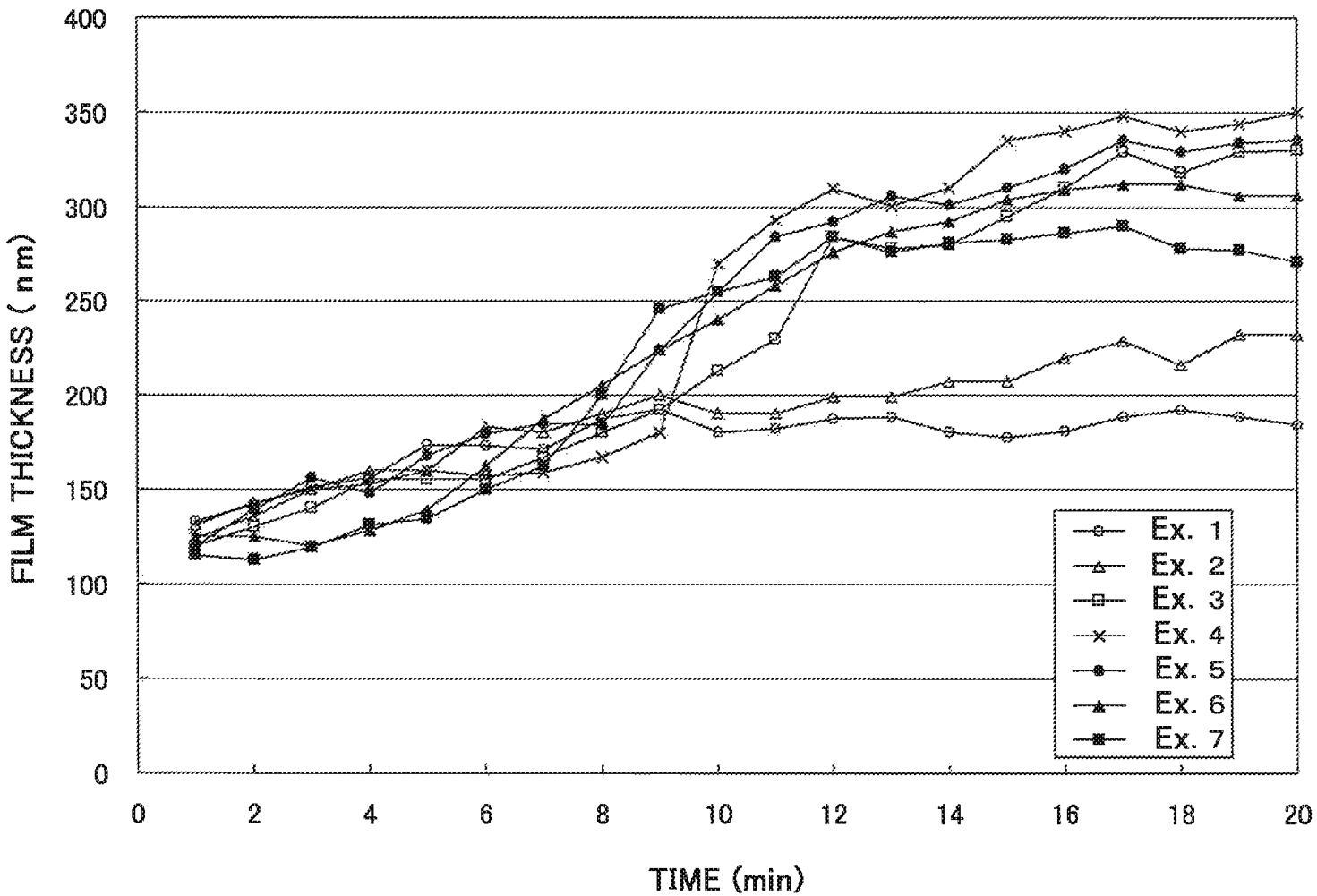
FIG. 5 is a graph showing the results of the film thickness measuring tests of Examples 1 to 7.
Figure 6:
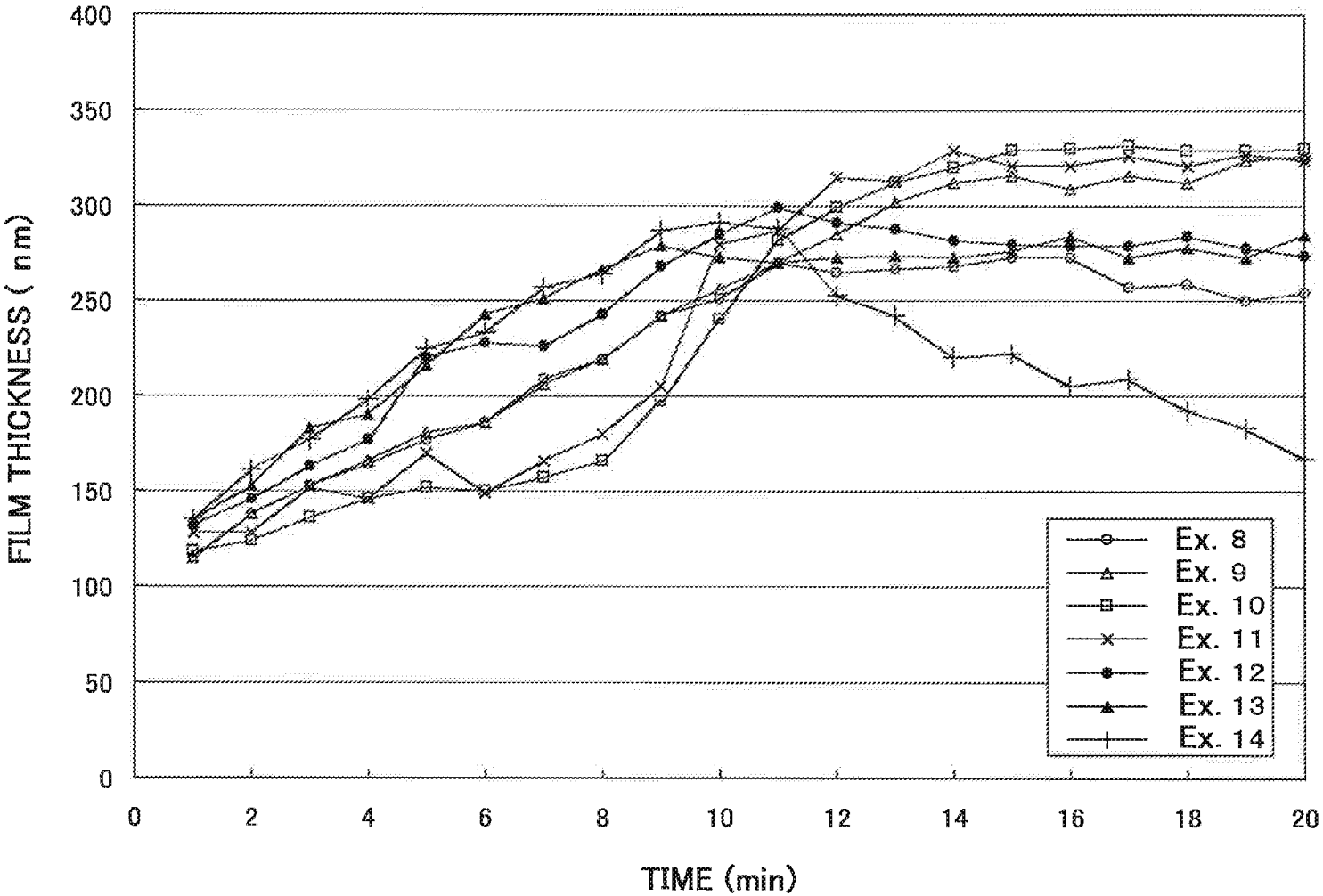
FIG. 6 is a graph showing the results of the film thickness measuring tests of Examples 8 to 14.
Figure 7:
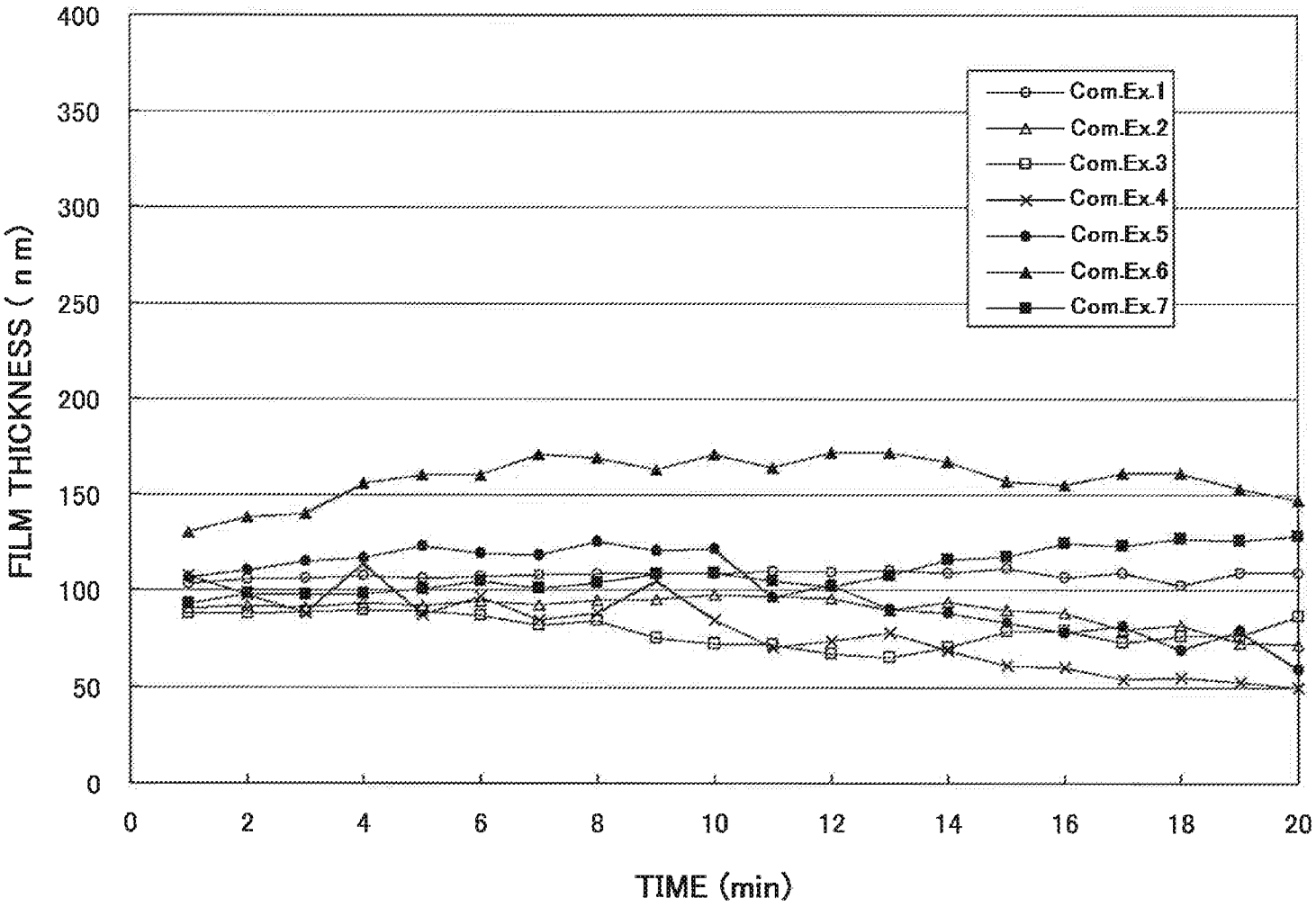
FIG. 7 is a graph showing the results of the film thickness measuring tests of Comparative Examples 1 to 7.

CHA and/or FDA was mixed in amounts shown in Tables 1, 2 and 3 to ADE (base oil) being the same parts by mass as the starting amines as the thickener, and the mixture was heated to 100° C. to prepare a solution A. Separately, MDI was mixed in an amount shown in Tables 1, 2 and 3 to ADE being the same parts by mass as the MDI as the thickener, and the mixture was heated to 140° C. to prepare a solution B. Next, another ADE for giving the amount of the thickener shown in Tables 1, 2 and 3 was heated to 100° C. and then, thereto was added the solution A. Subsequently, while stirring the ADE containing the solution A, the solution B was added thereto slowly. Thereafter, the mixture was allowed to stand at 150° C. over 60 minutes, and then cooled to room temperature, followed by homogenization treatment with a 3-roll mill to obtain, a grease composition. To the grease composition was added 2 parts by mass of an amine antioxidant. With respect to the obtained grease composition as sample grease, a film thickness measuring test and a test for service life against seizure were carried out. The results of the film thickness measuring test are shown in Tables 4 to 6 and FIGS. 5 to 7, and the results of the test for service life against seizure are shown in Tables 1 to 3.

TABLE 1

| | | Examples | | | | | | |
|---|---|---|---|---|---|---|---|---|
| | | 1 | 2 | 3 | 4 | 5 | 6 | 7 |
| Starting material of thickener (molar ratio) | MDI | 50 | 50 | 50 | 50 | 50 | 50 | 50 |
| | CHA | 91 | 93 | 94 | 95 | 96 | 98 | 99 |
| | PDA | 9 | 7 | 6 | 5 | 4 | 2 | 1 |

TABLE 1-continued

| | Examples | | | | | | |
|---|---|---|---|---|---|---|---|
| | 1 | 2 | 3 | 4 | 5 | 6 | 7 |
| Amount of thickener based on 100 parts by mass of the total amount of the base oil and the thickener (part by mass) | 20 | 20 | 20 | 20 | 20 | 20 | 20 |
| Service life against seizure (hr) | 2140 | 2300 | 2360 | 2500 | 2440 | 2320 | 2300 |

TABLE 2

| | | Examples | | | | | | |
|---|---|---|---|---|---|---|---|---|
| | | 8 | 9 | 10 | 11 | 12 | 13 | 14 |
| Starting material of thickener (molar ratio) | MDI | 50 | 50 | 50 | 50 | 50 | 50 | 50 |
| | CHA | 95 | 95 | 95 | 95 | 95 | 95 | 95 |
| | PDA | 5 | 5 | 5 | 5 | 5 | 5 | 5 |
| Amount of thickener based on 100 parts by mass of the total amount of the base oil and the thickener (part by mass) | | 9 | 10 | 15 | 25 | 28 | 30 | 35 |
| Service life against seizure (hr) | | 2200 | 2260 | 2400 | 2460 | 2520 | 2540 | 2220 |

TABLE 3

| | | Comparative Examples | | | | | | |
|---|---|---|---|---|---|---|---|---|
| | | 1 | 2 | 3 | 4 | 5 | 6 | 7 |
| Starting material of thickener (molar ratio) | MDI | 50 | 50 | 50 | 50 | 50 | 50 | 50 |
| | CHA | 0 | 10 | 30 | 50 | 70 | 90 | 100 |
| | PDA | 100 | 90 | 70 | 50 | 30 | 10 | 0 |
| Amount of thickener based on 100 parts by mass of the total amount of the base oil and the thickener (part by mass) | | 20 | 20 | 20 | 20 | 20 | 20 | 20 |
| Service life against seizure (hr) | | 1760 | 1720 | 1680 | 1740 | 1800 | 1920 | 1800 |

TABLE 4

| Time period after starting of rotation (min) | Grease film thickness (nm) Examples | | | | | | |
|---|---|---|---|---|---|---|---|
| | 1 | 2 | 3 | 4 | 5 | 6 | 7 |
| 1 | 133 | 131 | 120 | 124 | 120 | 125 | 115 |
| 2 | 142 | 143 | 130 | 136 | 139 | 125 | 113 |
| 3 | 151 | 150 | 140 | 150 | 156 | 120 | 119 |
| 4 | 156 | 160 | 155 | 153 | 148 | 128 | 131 |
| 5 | 174 | 160 | 155 | 160 | 168 | 139 | 135 |
| 6 | 173 | 183 | 155 | 157 | 179 | 162 | 150 |
| 7 | 171 | 180 | 167 | 159 | 185 | 187 | 162 |
| 8 | 187 | 190 | 180 | 167 | 184 | 205 | 200 |
| 9 | 192 | 200 | 192 | 180 | 224 | 224 | 246 |
| 10 | 180 | 190 | 213 | 270 | 255 | 240 | 255 |
| 11 | 182 | 190 | 230 | 293 | 284 | 258 | 263 |
| 12 | 187 | 199 | 284 | 310 | 292 | 276 | 284 |
| 13 | 188 | 199 | 278 | 301 | 306 | 287 | 276 |
| 14 | 180 | 207 | 280 | 310 | 301 | 292 | 281 |
| 15 | 177 | 207 | 295 | 335 | 310 | 304 | 283 |

TABLE 4-continued

| Time period after starting of rotation (min) | Grease film thickness (nm) Examples | | | | | | |
|---|---|---|---|---|---|---|---|
| | 1 | 2 | 3 | 4 | 5 | 6 | 7 |
| 16 | 180 | 220 | 310 | 340 | 320 | 309 | 286 |
| 17 | 188 | 229 | 329 | 348 | 335 | 312 | 290 |
| 18 | 192 | 216 | 318 | 340 | 329 | 312 | 278 |
| 19 | 188 | 232 | 329 | 344 | 334 | 306 | 277 |
| 20 | 184 | 232 | 330 | 350 | 335 | 306 | 271 |

TABLE 5

| Time period after starting of rotation (min) | Grease film thickness (nm) Examples | | | | | | |
|---|---|---|---|---|---|---|---|
| | 8 | 9 | 10 | 11 | 12 | 13 | 14 |
| 1 | 115 | 115 | 118 | 128 | 132 | 135 | 135 |
| 2 | 138 | 138 | 124 | 128 | 146 | 153 | 161 |
| 3 | 153 | 153 | 136 | 152 | 163 | 183 | 177 |
| 4 | 164 | 166 | 146 | 146 | 177 | 190 | 198 |
| 5 | 177 | 181 | 152 | 170 | 220 | 216 | 225 |
| 6 | 186 | 186 | 150 | 149 | 228 | 243 | 233 |
| 7 | 209 | 206 | 157 | 166 | 226 | 251 | 257 |
| 8 | 219 | 219 | 166 | 180 | 243 | 267 | 264 |
| 9 | 242 | 242 | 197 | 205 | 268 | 279 | 287 |
| 10 | 251 | 256 | 240 | 280 | 285 | 273 | 291 |
| 11 | 270 | 270 | 282 | 287 | 299 | 270 | 288 |
| 12 | 265 | 285 | 299 | 315 | 291 | 273 | 253 |
| 13 | 267 | 302 | 312 | 313 | 288 | 274 | 242 |
| 14 | 268 | 312 | 320 | 329 | 282 | 273 | 220 |
| 15 | 273 | 316 | 329 | 321 | 280 | 276 | 222 |
| 16 | 273 | 309 | 330 | 321 | 279 | 284 | 205 |
| 17 | 257 | 316 | 332 | 326 | 279 | 273 | 209 |
| 18 | 259 | 312 | 329 | 321 | 284 | 278 | 192 |
| 19 | 250 | 324 | 329 | 327 | 278 | 273 | 183 |
| 20 | 254 | 326 | 330 | 324 | 274 | 285 | 167 |

TABLE 6

| Time period after starting of rotation (min) | Grease film thickness (nm) Comparative Examples | | | | | | |
|---|---|---|---|---|---|---|---|
| | 1 | 2 | 3 | 4 | 5 | 6 | 7 |
| 1 | 103 | 91 | 88 | 107 | 107 | 130 | 93 |
| 2 | 106 | 92 | 88 | 98 | 110 | 138 | 98 |
| 3 | 106 | 91 | 89 | 88 | 115 | 140 | 98 |
| 4 | 108 | 93 | 90 | 114 | 117 | 156 | 98 |
| 5 | 106 | 92 | 89 | 87 | 123 | 160 | 100 |
| 6 | 107 | 94 | 87 | 97 | 119 | 160 | 105 |
| 7 | 108 | 92 | 82 | 84 | 118 | 171 | 101 |
| 8 | 108 | 95 | 84 | 88 | 125 | 169 | 104 |
| 9 | 109 | 95 | 75 | 105 | 121 | 163 | 108 |
| 10 | 109 | 98 | 72 | 84 | 122 | 171 | 109 |
| 11 | 110 | 97 | 72 | 71 | 96 | 164 | 105 |
| 12 | 110 | 96 | 67 | 74 | 103 | 172 | 102 |
| 13 | 110 | 90 | 65 | 78 | 90 | 172 | 108 |
| 14 | 109 | 94 | 71 | 69 | 88 | 167 | 116 |
| 15 | 111 | 90 | 79 | 61 | 83 | 157 | 117 |
| 16 | 107 | 88 | 79 | 60 | 78 | 155 | 124 |
| 17 | 109 | 79 | 73 | 54 | 81 | 161 | 123 |
| 18 | 102 | 82 | 76 | 55 | 69 | 161 | 127 |
| 19 | 109 | 73 | 76 | 53 | 79 | 153 | 126 |
| 20 | 109 | 72 | 87 | 50 | 59 | 147 | 128 |

EXPLANATIONS OF SYMBOLS

| | |
|---|---|
| 10 | Light source |
| 20 | Microscope |

-continued

| EXPLANATIONS OF SYMBOLS | |
|---|---|
| 30 | Drive motor |
| 40 | Spindle |
| 50 | Disc |
| 51 | Glass disc |
| 52 | Chromium film |
| 53 | Silica film |
| 60 | Steel ball of bearing |
| 61 | Pillow block for receiving steel ball |
| 70 | Spectrometer |
| 71 | Micrometer |
| 72 | Camera |
| 80 | Monitor |
| 90 | Computer |
| 100 | Sample grease |
| 101 | Sample grease |
| A | Emitted light |
| B1 | Reflected light |
| B2 | Reflected light |

What is claimed is:

1. A grease composition comprising a base oil and a thickener, wherein said thickener is a diurea compound obtained by allowing an amine mixture comprising (a) alkylphenylamine, wherein the alkyl group thereof has 8 to 16 carbon atoms, and (b) cyclohexylamine, to react with a diisocyanate compound, wherein a molar ratio of said cyclohexylamine in the amine mixture is from 93 to 99% by mole.

2. The grease composition according to claim 1, wherein an amount of said thickener is from 9 to 30 parts by mass based on 100 parts by mass of the total amount of the base oil and the thickener.

* * * * *